US006130513A

United States Patent [19]

Orton

[11] Patent Number: 6,130,513

[45] Date of Patent: Oct. 10, 2000

[54] R/C SPEED CONTROLLER WITH SYNCHRONOUS FLYBACK CIRCUIT

[76] Inventor: Kevin R. Orton, Tekin Electronics, Inc., 940 Calle Negocio, Suite 140, San Clemente, Calif. 92673

[21] Appl. No.: 09/340,831

[22] Filed: Jun. 28, 1999

Related U.S. Application Data

[63] Continuation-in-part of application No. 09/152,372, Sep. 14, 1998, Pat. No. 5,925,992.

[51] Int. Cl.[7] ..... H02P 7/10

[52] U.S. Cl. ..... 318/16; 318/139; 318/380; 446/456

[58] Field of Search ..... 318/139, 16, 269, 318/446, 273, 362–382; 388/811, 804; 446/431, 435, 456

[56] References Cited

U.S. PATENT DOCUMENTS

| | | | |
|---|---|---|---|
| 4,275,394 | 6/1981 | Mabuchi et al. | 340/694 |
| 4,360,808 | 11/1982 | Smith, III et al. | 340/825.69 |
| 4,930,393 | 6/1990 | Castro, Jr. | 89/1.814 |
| 5,041,825 | 8/1991 | Hart et al. | 340/825.06 |
| 5,136,452 | 8/1992 | Orton | 361/33 |
| 5,216,337 | 6/1993 | Orton et al. | 318/16 |
| 5,343,482 | 8/1994 | Hale et al. | 363/98 |
| 5,629,590 | 5/1997 | Yamamoto | 318/16 |
| 5,903,130 | 5/1999 | Rice et al. | 318/811 |
| 5,925,992 | 7/1999 | Orton | 318/16 |

*Primary Examiner*—David Martin
*Assistant Examiner*—Rita Leykin
*Attorney, Agent, or Firm*—Loyal McKinley Hanson

[57] ABSTRACT

A radio controlled (R/C) speed controller with a synchronous flyback circuit includes a first node for connection to a first battery terminal and a first motor terminal, a second node for connection to a second battery terminal, and a third node for connection to a second motor terminal. A drive subcircuit is connected between the second and third nodes for switching between a DRIVE ON state a DRIVE OFF state, a brake subcircuit is connected between the first and third nodes for switching between a BRAKE ON state and a BRAKE OFF state, and a control subcircuit switches the drive and brake subcircuits under program control. The brake subcircuit includes a diode that is connected across the first and third nodes in order to conduct flyback current, the control subcircuit includes a sensing subcircuit for sensing when the diode is forward biased beyond a predetermined threshold level as an indication that the diode is conducting the flyback current, and the control subcircuit is programmed to switch the brake subcircuit to the BRAKE ON state in synchronism with the diode being forward biased beyond the predetermined threshold level in order to thereby more efficiently conduct the flyback current.

7 Claims, 3 Drawing Sheets

R/C SPEED CONTROLLER WITH SYNCHRONOUS FLYBACK CIRCUIT

CROSS-REFERENCE TO RELATED APPLICATION

This application is a continuation in part of the copending U.S. patent application by the same inventor that was filed Sep. 14, 1998 and assigned Ser. No. 09/152,372, now U.S. Pat. No. 5,925,992.

BACKGROUND OF THE INVENTION

1. Technical Field

This invention relates generally to circuitry and components for radio controlled (R/C) models, and more particularly to an R/C speed controller with increased functionality and improved ergonomic features.

2. Description of Related Art

The battery powered drive motor of a conventional R/C model operates under control of a control system that includes an onboard speed control module (or R/C model speed controller), a miniature onboard receiver, and a separate handheld transmitter unit. A user manipulates a throttle/brake trigger on the transmitter unit to input speed and braking setpoint information. The transmitter unit communicates that information to the speed controller via the onboard receiver. The speed controller controls the drive motor accordingly.

An existing speed controller includes an electronic circuit that is adapted (i) to be mounted on an R/C model, (ii) to be connected to a battery, a motor, and a receiver on the R/C model, and (iii) to couple power from the battery to the motor according to speed and braking information received via the receiver. The electronic circuit may include a preprogrammed controller that is an electronic device adapted to control operation of the electronic circuit under program control according to a stored setting for each of a group of operating parameters. The parent application (Ser. No. 09/152,372) describes an R/C model speed controller circuit with two pushbutton switches and a front panel row of at least four light-emitting elements that cooperate with the preprogrammed controller to significantly facilitate the task of changing operating parameters. The user simply actuates the pushbutton switches while viewing information displayed by the row of light-emitting elements. That is done without having to manipulate potentiometers while viewing a separate meter connected to a test point on the speed controller and without having to enter data and commands via a miniature keypad.

A separate problem not addressed in the parent application relates to flyback current. Whenever the motor is turned off, the motor's collapsing magnetic field combined with other motor attributes produces a flyback current in a known way that flows through the a flyback diode in the brake circuit of the speed controller. The power dissipated by the flyback diode can be significant to an R/C enthusiast bent on obtaining maximum efficiency and use of limited battery power. Thus, such R/C enthusiasts need a more efficient flyback circuit than currently existing in R/C speed controllers.

SUMMARY OF THE INVENTION

This invention addresses the problems outlined above by providing an R/C model speed controller circuit with a synchronous flyback circuit. The speed controller circuit senses a forward voltage drop across a flyback diode (usually a part of a brake circuit MOSFET) and the preprogrammed controller switches the brake circuit on in synchronism with such an occurrence to more efficiently conduct the flyback current via the lower impedance of the brake circuit. The resulting increase in efficiency can eliminate the need for a heatsink on the brake MOSFET of which the flyback diode is a part, and it may reduce overall power dissipated from about nine watts to about three or four watts.

To paraphrase some of the more precise language appearing in the claims, a speed controller circuit for an R/C model includes a first node for connection to a first battery terminal and a first motor terminal, a second node for connection to a second battery terminal, and a third node for connection to a second motor terminal. A drive subcircuit is connected between the second and third nodes for switching between a DRIVE ON state of the drive subcircuit in which the drive subcircuit couples the second node to the third node, in order to couple the second battery terminal to the second motor terminal and thereby power the motor, and a DRIVE OFF state of the drive subcircuit in which the second node is decoupled from the third node. A brake subcircuit is connected between the first and third nodes for switching between a BRAKE ON state of the brake subcircuit in which the brake subcircuit couples the first node to the third node, in order to couple the first motor terminal to the second motor terminal and thereby brake the motor, and a BRAKE OFF state of the brake subcircuit in which the first node is decoupled from the third node. A control subcircuit is connected to the drive subcircuit and the brake subcircuit for switching the drive subcircuit and the brake subcircuit under program control.

The brake subcircuit includes a diode connected to the first and third nodes as means for conducting a flyback current, and the control subcircuit includes means for sensing when the diode is forward biased beyond a predetermined threshold level as an indication that the diode is conducting the flyback current. The control subcircuit is programmed to switch the brake subcircuit to the BRAKE ON state in synchronism with the diode being forward biased beyond the predetermined minimal threshold level in order to thereby more efficiently conduct the flyback current.

In line with the above, a method of conducting flyback current in a speed controller circuit for a radio controlled model includes the step of providing a speed controller circuit as described above. The method proceeds by sensing when the diode is forward biased beyond a predetermined threshold level as an indication that the diode is conducting the flyback current, and switching the brake subcircuit to the BRAKE ON state in synchronism with the diode being forward biased beyond the predetermined threshold level in order to thereby more efficiently conduct the flyback current. The following illustrative drawings and detailed description make the foregoing and other objects, features, and advantages of the invention more apparent.

DESCRIPTION OF THE PREFERRED EMBODIMENTS

Figure 1:
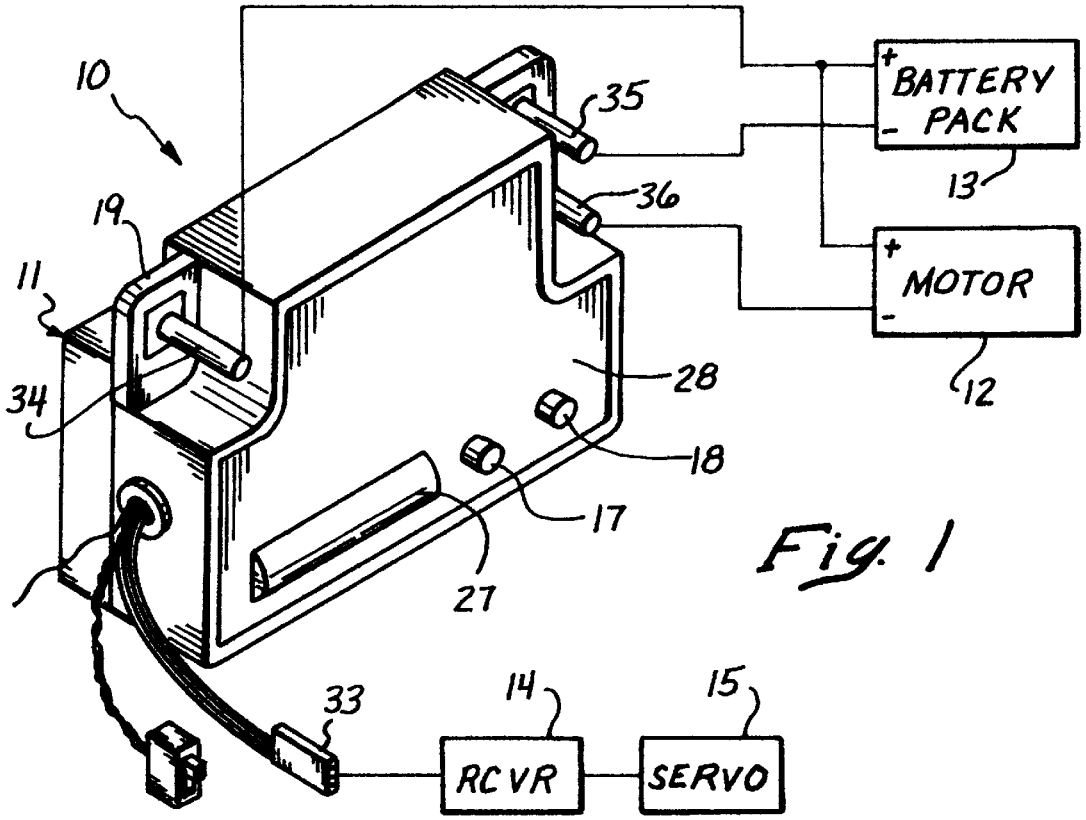
FIG. 1 of the drawings is a perspective top, front, and left side view of an R/C model speed controller constructed according to the invention, with connections to auxiliary components shown diagrammatically.
Figure 2:
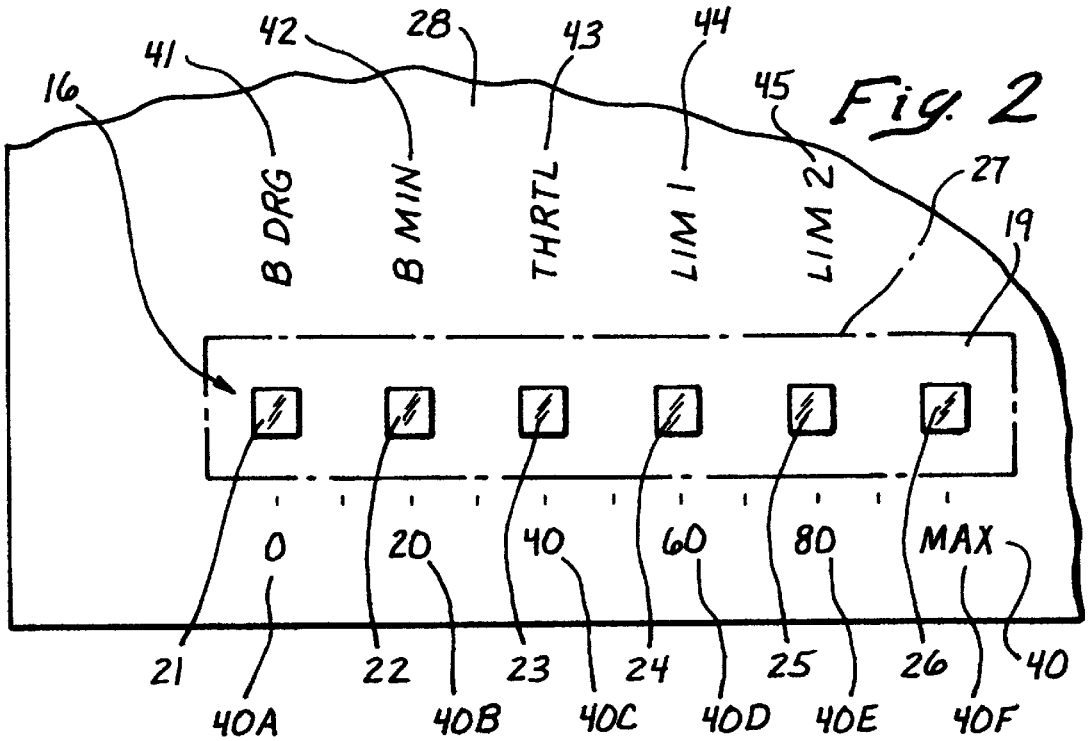
FIG. 2 is an enlarged front view of a portion of the speed controller showing details of the row of at least six light-emitting elements.
Figure 3:
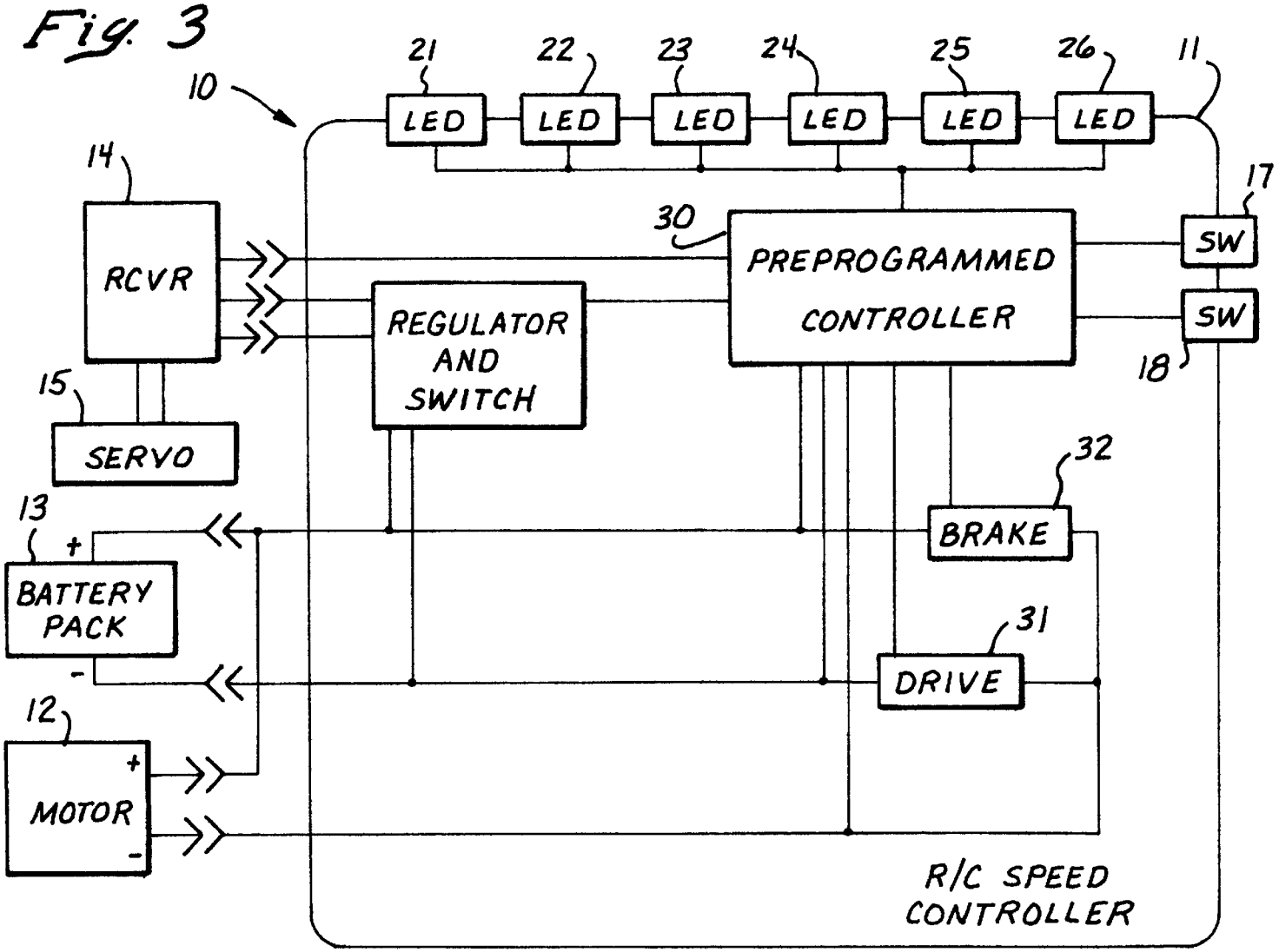
FIG. 3 is a block schematic diagram of the circuitry employed.

The description of the preferred embodiments begins with a description of the speed controller 10 as set forth in the parent application and FIGS. 1–3 of the drawings. A speed controller 100 with a synchronous flyback circuit constructed according to the instant invention is then described with reference to FIG. 4. A reader already familiar with the specification and FIGS. 1–3 of the parent application may proceed directly to the description of the synchronous flyback circuit of the speed controller 100.

Digital Setup and Light Bar. FIGS. 1–3 show various details of a speed controller 10 constructed according to the invention. It may be similar in some respects to the prior art speed controller described in U.S. Pat. No. 5,577,154 issued to Orton. That patent is incorporated herein by this reference for the overview and related details of construction it provides.

Like the prior art speed controller described in U.S. Pat. No. 5,577,154, the speed controller 10 of this invention includes a module 11 (FIG. 1) that is adapted to be mounted on an R/C model (not shown) and connected to a motor 12, a battery 13, and a receiver 14 that controls a steering servo 15.

So mounted and connected, the speed controller 10 operates in a known way in many respects to couple power from the battery 13 to the motor 12 according to speed and braking information received via the receiver 14.

Unlike the prior art speed controller, however, the speed controller 10 of this invention includes a digital setup arrangement that significantly improves speed controller operation by providing precise parametric setup of critical operating parameters. The speed controller 10 includes a row 16 (FIG. 2) of six light-emitting elements (e.g., light-emitting diodes or LEDs preferably disposed in a straight line) that are designated in the drawings as LEDs 21–26 (FIGS. 1 and 3). Proceeding from left to right (from the user's viewpoint), the first LED 21 is the first LED in the row 16, followed sequentially by the second LED 22, the third LED 23, the fourth LED 24, the fifth LED 25, and the sixth LED 26.

The LEDs 21–26 function in conjunction with first and second pushbutton switches 17 and 18 (FIGS. 1 and 3) to facilitate parametric setup. The LEDs 21–26 are supported within the module 11 by a circuitboard 19 that is visible in FIGS. 1 and 2, and they are covered by a lens 27 (FIG. 1) so that each one is individually discernible by a user facing a front panel 28 of the module 11. The lens 27 magnifies the LEDs 21–26 and the pushbutton switches 17 and 18 are located so that the user can operate them while viewing the front panel 28 (i.e., the LEDs 21–26).

The LEDs 21–26 and the pushbutton switches 17 and 18 are operatively connected to a preprogrammed controller 30 (FIG. 3) that is part of electronic circuitry mounted on the circuitboard 19 within the module 11. The preprogrammed controller 30 may take the form of a commercially available peripheral interface controller (PIC) that is preprogrammed using known techniques to function as described. PICs are readily available from any of various sources, including Microchip Technology Inc. and Analog Devices Inc., and they are well known and commonly used components. Based upon the foregoing and subsequent descriptions, one of ordinary skill in the art can readily fabricate suitable circuitry and preprogram the controller to function as described.

Once the battery 13, the motor 12, and the receiver 14 are connected to the electronic circuitry, the electronic circuitry operates in a known way in many respects to control a drive circuit 31 and a brake circuit 32 according to speed and braking information received via the receiver 14. The electronic circuitry is adapted to be interconnected with the battery 13, the motor 12, and the receiver 14 in the sense that it includes a connector 33 (FIG. 1) that enables the user to connect the receiver 14 to the electronic circuitry and it includes terminals 34, 35, and 36 (FIG. 1) that enable the user to connect the battery 13 and the motor 12 to the electronic circuitry. The electronic circuitry is adapted to be mounted on an R/C model in the sense that is physically small enough to fit on the R/C model on which it is intended to be used. As a further idea of size, the illustrated module 11 is about 1.75 inches by 1.25 inches by 0.75 inches, with the lens 27 measuring about 0.8 inch long.

In addition to its other functions, the preprogrammed controller 30 is programmed to respond to actuation of the pushbutton switches 17 and 18 and to activate each of the LEDs 21–26 as subsequently described. It is programmed so that the user can setup (i.e., change) the setting (i.e., the value) of various speed controller operating parameters by actuating the pushbutton switches 17 and 18 while viewing feedback information provided by the row 16 of the LEDs 21–26. The user actuates the pushbutton switches 17 and 18 in a predetermined sequence of steps set by the manner in which the preprogrammed controller 30 is programmed, and the LEDs 21–26 display related information. The preprogrammed controller 30 is preferably programmed to respond to actuation of the pushbutton switch 17 by selecting an operating parameter to be change, and to actuation of the pushbutton switch 18 by changing the value of the selected operating parameter.

Stated another way, the preprogrammed controller 30 is an electronic device that is adapted to control operation of the electronic circuit under program control according to a stored setting for each of a group of operating parameters. The first pushbutton switch 17 is operatively connected to the preprogrammed controller 30 to cooperate with the preprogrammed controller 30 as means for enabling a user to select a particular parameter from the group of operating parameters. The second pushbutton switch 18 is operatively connected to the preprogrammed controller 30 to cooperate with the preprogrammed controller 30 as means for enabling the user to change the stored setting for the particular parameter selected. The LEDs 21–26 are operatively connected to the preprogrammed controller 30 to cooperate with the preprogrammed controller 30 as means for displaying information identifying the particular parameter selected and information indicative of the stored setting for the particular parameter selected.

According to one aspect of the invention, the preprogrammed controller 30 is programmed to activate individual ones of the LEDs 21–26 in response to actuation of the second pushbutton switch 18 in order to indicate six corresponding values, and to activate adjacent ones of the LEDs 21–26 two at a time to indicate five intermediate values. Thus, it can indicate eleven separate values, such as, for example, zero to 100 percent of some maximum value in ten percent increments.

More specifically, the preprogrammed controller 30 is programmed to activate the first LED 21 to indicate a first value for a selected operating parameter that the user is changing. The first value may, for example, be some minimum value for the selected operating parameter that the user can adjust in ten equal increments (ten percent increases) to some maximum value for that operating parameter. Similarly, the preprogrammed controller 30 is programmed to activate the second LED 22 to indicate a second value (e.g., the first value increased by twenty percent), to activate the third LED 23 to indicate a third valve (e.g., the first value increased by forty percent), to activate the fourth LED 24 to indicate a fourth valve (e.g., the first value increased by sixty percent), to activate the fifth LED 25 to indicate a fifth valve (e.g., the first value increased by eighty percent), and to activate the sixth LED 26 to indicate a sixth value (e.g., a maximum value for the selected operating parameter that is the first value increased by one hundred percent of the total amount of increase).

In addition, the preprogrammed controller 30 is programmed to activate pairs of the LEDs 21–26 in response to actuation of the second pushbutton switch 18 to indicate intermediate values. It is programmed to activate both the first and second LEDs 21 and 22 simultaneously to indicate a first intermediate value that is intermediate the first and second values (e.g., ten percent), to activate both the second and third LEDs 22 and 23 simultaneously to indicate a second intermediate value that is intermediate the second and third values (e.g., thirty percent), to activate both the third and fourth LEDs 23 and 24 simultaneously to indicate a third intermediate value that is intermediate the third and fourth values (e.g., fifty percent), to activate both the fourth and fifth LEDs 24 and 25 simultaneously to indicate a fourth intermediate value that is intermediate the fourth and fifth values (e.g., seventy percent), and to activate both the fifth and sixth LEDs 25 and 26 simultaneously to indicate a fifth intermediate value that is intermediate the fifth and sixth values (e.g., ninety percent). Thus, the LED arrangement of the R/C model speed controller 10 improves upon some existing light bar arrangements by precisely displaying eleven values using just six LEDs 21–26.

Preferably, a scale 40 with six value labels 40A through 40F is provided on the front panel 28 adjacent to the lens 27 that covers the row 16 of LEDs 21–26 (FIG. 2). The scale 40 begins with the label 40A representing the numeral "0" at a left end of the scale 40 (from the user's point of view) in a position adjacent to the LED 21, and proceeds in equal increments to the label 40F representing the abbreviation "MAX" (for "maximum" or one hundred percent) at a right end of the scale 40 in a position adjacent to the LED 26, to thereby provide indicia relating the LEDs 21–26 to the eleven values various ones of the LEDs 21–26 indicate. For that purpose, the scale 40 also includes the label 40B representing "20" adjacent to the LED 22, the label 40C representing "40" adjacent to the LED 23, the label 40D representing "60" adjacent to the LED 24, and the label 40E representing "80" adjacent to the LED 25. The labels are affixed to or otherwise added to the front panel 28 by any of various suitable known means (e.g., a stick-on placard).

Operating parameter labels 43–45 are also preferably provided to relate particular ones of the LEDs 21–25 to the operating parameters they indicate. A label 41 (i.e., B DRAG) relates the first LED 21 to a B DRAG operating parameter. Similarly, a label 42 (i.e., B MIN) relates the second LED 22 to a B MIN operating parameter, a label 43 (i.e., THRTL) relates the third LED 23 to a THRTL operating parameter, a label 44 (i.e., LIM 1) relates the fourth LED 24 to a LIM 1 operating parameter, and a label 45 relates the fifth LED 25 (i.e., LIM 2) to a LIM 2 operating parameter.

A sixth operating parameter label is not provided in the illustrated embodiment for the sixth LED 26, but it could be within the broader inventive concepts disclosed. Moreover, five intermediate operating parameter labels (not shown) can be provided without departing from the scope of the claims. First, a first intermediate label between the labels 41 and 42 that is designated by simultaneous activation of the LED 21 and the LED 22). Second, a second intermediate label between the labels 42 and 43 that is designated by simultaneous activation of the LED 22 and the LED 23). Similarly, a third intermediate label between the labels 43 and 44 (designated by simultaneous activation of the LED 23 and the LED 24), a fourth intermediate label between the labels 44 and 45 (designated by the simultaneous activation of the LED 24 and the LED 25), and a fifth intermediate label between the labels 45 and 46 (designated by the simultaneous activation of the LED 25 and the LED 26).

Thus, the speed controller 10 includes at least four LEDs (preferably the six illustrated LEDs 21–26), a value label associated with each of the LEDs, an operating parameter label associated with each of the LEDs, and at least two pushbuttons. With four LEDs (and thus four operating parameters and seven values) that arrangement enables the operator to individually setup each of the four operating parameters with any one of the seven values. In other words, the user can setup any one of 2,401 combinations of operating parameter values (i.e., seven raised to the fourth power).

With six LEDs (and thus six operating parameters and eleven values), the user can setup any one of 1,771,561 combinations (eleven raised to the sixth power). If zero is omitted as a value, six LEDs still enable the user to setup any one of 1,000,000 combinations (ten raised to the sixth power). By including the five intermediate operating parameter labels previously mentioned, over 285 billion combinations are possible (eleven raised to the eleventh power).

Based upon the foregoing and subsequent descriptions, one of ordinary skill in the art can readily program the preprogrammed controller 30 to function as described within the scope of the claims, and any of various pushbutton actuation routines may be implemented. The illustrated R/C model speed controller 10 involves two basic steps. The first step is to actuate the first pushbutton switch 17 (also referred to as the MODE button) to select an operating parameter. The second step is to actuate the second pushbutton switch 18 (also referred to as a INCR button) to set the valve for the selected operating parameter.

First, press the first pushbutton switch (i.e., the MODE button) to access the desired setup mode. The light will start blinking to indicate that mode selection is underway. Continue pressing the MODE button until the light indicates the desired mode (i.e., the desired operating parameter). Do not wait longer than five seconds to select the mode, or else the speed controller will return to normal operation. Once the mode is selected, move on to the second step within five seconds, or else the speed controller will return to normal operation.

Second, press the second pushbutton switch 18 (i.e., the INCR button) to adjust the setting of the selected mode. The first time the INCR button is pressed, the LEDs 21–26 (i.e., the bar graph display) will indicate the existing value (i.e., the existing setting) for the selected mode. Each time the INCR button is pressed after the first time, the bar graph display advances toward one hundred percent of maximum value until it reaches the MAX at the high end of the scale 40. It then starts over again at zero percent of MAX value at the zero (0) at the low end of the scale 40.

If two LEDs of the bar graph display are on at the same time, it indicates a value midway between a value indicated by one of the two LEDs and a value indicated by the other one of the two LEDs. Thus, the six LEDs 21–26 serve to indicate zero through one hundred percent in ten-percent increments. If the user waits longer than five seconds to set the value, the speed controller returns to normal operation. If the user wants to select another operating parameter, he presses the MODE button again to select it.

Each of the six LEDs 21–26 indicates a respective one of six modes (i.e., operating parameters). The first LED 21 indicates a B MIN mode (i.e., a BRAKE MINIMUM mode). The B MIN mode controls how strongly the brakes initially engage in response to trigger movement. Higher values make the brakes come on strong initially, and with a generally more aggressive response. This can speed up trigger response by eliminating unused trigger motion, but very light brake positions will be lost. A value of zero provides very light, fine braking action.

The second LED 22 indicates a B DRG mode (i.e., a DRAG BRAKE mode). The B DRG mode sets the amount of braking occurring in the trigger neutral zone. This helps on some tracks by gently slowing down the R/C model when the user lets off the trigger from the throttle side. Higher values increase the amount of drag braking in the neutral zone. A value of zero provides no drag braking.

The third LED 23 indicates a NTRL mode (i.e., a NEUTRAL mode). The NTRL mode setting controls the deadband in between throttle and brake positions of the trigger where the R/C model just coasts. It adjusts from two percent of full trigger travel to ten percent of full trigger travel. The first LED indicates the two percent setting and the sixth LED indicates the ten percent setting.

Generally, narrower deadband settings provide quicker response to trigger movement for tight racing situations. The user may need to re-trim the throttle occasionally on the transmitter if an excessively narrow neutral range is used. This will also depend on the transmitter battery level.

The fourth LED 24 indicates a THRTL mode (i.e., a THROTTLE mode). The THRTL mode setting controls how aggressively the throttle comes as the user moves the trigger out of the deadband. Higher values increase the bottom end response, and require less trigger travel than lower values to reach a desired speed. A value of zero results in a linear response, with a very slow low speed crawl. The user should select a value based on motor power and gearing that provides smooth fluid trigger motion when driving.

The fifth LED 25 indicates a LIM 1 mode (i.e., a LIMIT 1 mode). On a DC electric motor, torque is proportional to current flow, and it is important to control how much current can flow to the motor in order to control torque and excessive wheelspin. The LIM 1 setting controls how much current can flow during the first three seconds of operation. The first LED indicates a setting of ten percent and the sixth LED indicates one hundred percent. The user sets the LIM 1 mode setting to set the amperage needed off the starting line. This will be a high value for high traction racing, and a low value for racing with capped tires and so forth.

The sixth LED 26 indicates a LIM 1 mode (i.e., a LIMIT 2 mode). The LIM 2 mode setting controls how much current can flow after the first three seconds of operation. The user sets this limiter to a high value for normal driving, or to a low value to conserve battery power and motor life or when driving on slippery tracks.

The preprogrammed controller 30 is also programmed to facilitate pit tuning. If the user is in the pit area and does not have access to his transmitter, he may still make speed controller adjustments by using the pit tuning feature. To do so, he depresses either the MODE button or the INCR button while turning the power switch on. This activates the settings and controls, but the motor will not run and the speed controller will not respond to receiver signals.

The preprogrammed controller 30 is also programmed for self testing. Before initiating that mode, however, the user makes sure that the rear wheels are free to spin. Then he depresses both the MODE button and the INCR button simultaneously for three seconds. That starts the self test mode. All LEDs 21–26 turn on, the brake and the throttle cycle on and off, and the motor should run. Other circuits are also tested. If everything is okay, the motor stops and all LEDs 21–26 flash. The self test mode resets all the mode settings and other operating parameters to factory default values.

The preprogrammed controller 30 is also programmed for radio calibration. The user turns on the transmitter and the speed controller while leaving the trigger in the neutral position. Then he depresses and holds down either the MODE button or the INCR button (but not both) for about five seconds until the first LED 21 starts blinking rapidly. Then the user pulls the trigger to the full throttle position followed by pushing it to the full brake position. Then he releases the trigger. After the first LED 21 stops blinking, the calibration is complete.

Figure 4:
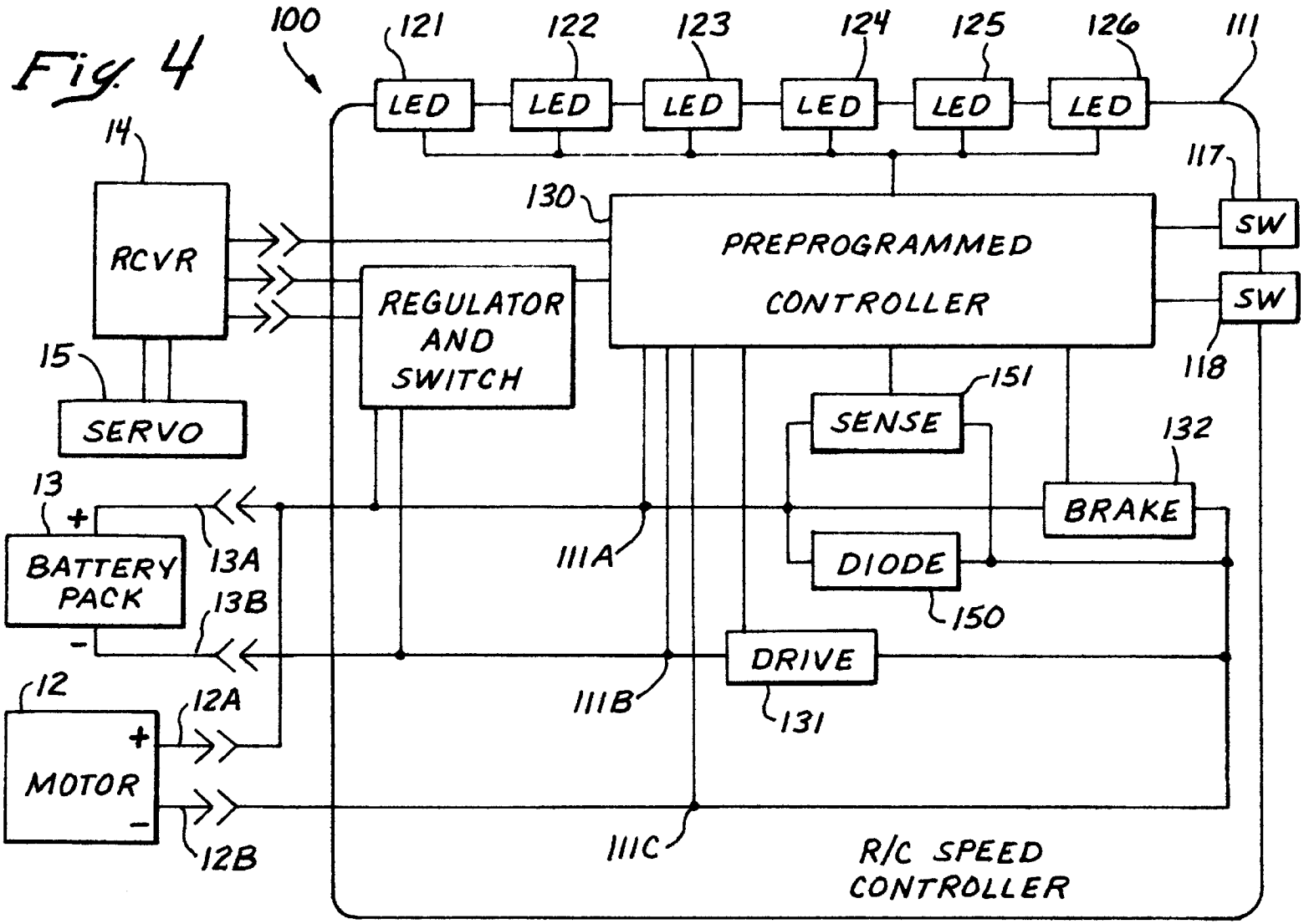
FIG. 4 is a block schematic diagram of another R/C speed controller that includes a synchronous flyback circuit constructed according to the invention.

Synchronous Flyback Circuit. FIG. 4 shows various details of a speed controller 100 constructed according to the invention. It is similar in many respects to the speed controller 10 described above and so only the differences are described in further detail. For convenience, reference numerals designating parts of the speed controller 100 are increased by one hundred over those designating related parts of the speed controller 10.

Like the speed controller 10, the speed controller 100 of this invention includes a module 111 that is adapted to be mounted on an R/C model (not shown) and connected to the motor 12, the battery 13, and the receiver 114 that controls the steering servo 115. So mounted and connected, the speed controller 100 couples power from the battery 13 to the motor 12 according to speed and braking information received via the receiver 14.

The circuit of the illustrated speed controller 100 also includes a digital setup arrangement like that described in the foregoing reference. It provides precise parametric setup of critical operating parameters. Six light-emitting diodes or LEDs (LED 121–126) may function in conjunction with first and second pushbutton switches 117 and 118 and a preprogrammed controller subcircuit 130 to facilitate parametric setup. Once the battery 13, the motor 12, and the receiver 14 (i.e., a signal source) are connected to the speed controller circuit and desired operating parameters have been entered, the speed controller circuit operates in a known way in many respects to control a drive circuit 131 and a brake circuit 132 according to speed and braking information received via the signal source (e.g., receiver 14).

The speed controller 100 is also adapted to be interconnected with the battery 13 and the motor 12 in the sense that it includes terminals that enable the user to connect the battery 13 and the motor 12 to first, second, and third nodes 111A, 111B, and 111C of the speed controller circuit. A first battery terminal 13A and a first motor terminal 12A are connected to the first node 111A, a second battery terminal 13B is connected to the second node 111B, and a second motor terminal 12B connects to the third node 111C.

As indicated in the block circuit diagram of FIG. 4, the speed controller circuit includes a drive subcircuit 131 that is connected between the second node 111B and the third node 111C. It switches under control of the preprogrammed controller 130 between a DRIVE ON state and a DRIVE OFF state of the drive subcircuit 131. The speed controller circuit also includes a brake subcircuit 132 connected between the first node 111A and the third node 111C. It switches under control of the preprogrammed controller 130 between a BRAKE ON state and a BRAKE OFF state of the brake subcircuit 132. The preprogrammed controller 130 functions as a control subcircuit for switching the drive subcircuit 131 and the brake subcircuit 132 under program control.

The brake subcircuit 132 may take any of various known forms (e.g., one or more MOSFETs) and it includes a diode 150 connected across the first and third nodes 111A and 111C (i.e., across the brake subcircuit 132) as means for conducting flyback current. The diode 150 does so in a known way and it may be part of a MOSFET in the brake subcircuit 132, with an impedance higher than the impedance of the brake subcircuit 132 when it is in the BRAKE ON state. Unlike prior art speed controllers, however, the speed controller 100 also includes a synchronous flyback arrangement designed to more efficiently conduct flyback current in concert with the flyback diode 150. A sensor subcircuit 151 senses whenever the forward voltage drop across the diode 150 reaches a predetermined threshold level (e.g., 0.01 volts). When such a condition is sensed, the sensor subcircuit 151 produces a control signal that the preprogrammed controller 130 is programmed to accept as indicating such a condition exists. In addition to its other functions, the preprogrammed controller 130 is programmed to respond to the control signal by switching the brake subcircuit 132 to the BRAKE ON state so that most of the flyback current flows through the lower impedance path provided by the brake subcircuit 132. That results in greater efficiency.

The sensor subcircuit 151 may take any of various known forms for that purpose (e.g., a separate operational amplifier circuit or part of the preprogrammed controller 130). Various additional criteria may be preprogrammed to most effectively switch the brake circuit 132 in synchronism with conduction of flyback current though the diode 150. The end result is that conduction of flyback current through the lower impedance path provided by the brake subcircuit 132 decreases heat and increases efficiency. Based upon the descriptions herein and the claims, one of ordinary skill in the art can readily provide the circuitry and programming to implement the invention.

Thus, the invention provides an R/C model speed controller with a synchronous flyback circuit that senses a forward voltage drop across the flyback diode and advantageously switches the brake circuit on in synchronism with such an occurrence to more efficiently conduct the flyback current. The resulting increase in efficiency can eliminate the need for a heatsink on the brake MOSFET of which the flyback diode is a part, and it may reduce overall power dissipated from about nine watts to about three or four watts.

What is claimed is:

1. A speed controller circuit for a radio controlled model, comprising:

a first node for connection to a first battery terminal and a first motor terminal, a second node for connection to a second battery terminal, and a third node for connection to a second motor terminal;

drive subcircuit means connected between the second and third nodes for switching between a DRIVE ON state and a DRIVE OFF state of the drive subcircuit;

brake subcircuit means connected between the first and third nodes for switching between a BRAKE ON state and a BRAKE OFF state of the brake subcircuit; and control subcircuit means connected to the drive subcircuit and the brake subcircuit for switching the drive subcircuit and the brake subcircuit under program control;

wherein the brake subcircuit includes a diode connected across the first and third nodes as means for conducting a flyback current;

wherein the control subcircuit means includes sensing means for sensing when the diode is forward biased beyond a predetermined threshold level as an indication that the diode is conducting the flyback current; and wherein the control subcircuit means is programmed to switch the brake subcircuit to the BRAKE ON state in synchronism with the diode being forward biased beyond the predetermined threshold level in order to thereby more efficiently conduct the flyback current.

2. A speed controller circuit as recited in claim 1, wherein the sensing means includes a sensing subcircuit connected across the diode.

3. A speed controller circuit as recited in claim 1, wherein the control subcircuit means includes a preprogrammed controller.

4. A speed controller circuit as recited in claim 1, wherein the control subcircuit means is programmed to turn the brake subcircuit to the BRAKE ON state whenever (i) the drive subcircuit is in the DRIVE OFF state, and (ii) the sensing means senses that the diode is forward biased beyond the predetermined minimal threshold level.

5. A speed controller circuit as recited in claim 4, wherein the control subcircuit means is programmed to turn the brake subcircuit to the BRAKE OFF state whenever (i) the control circuit means is about to switch the drive subcircuit to the DRIVE ON state, (ii) the sensing means does not sense that the diode is forward biased beyond the predetermined minimal threshold level.

6. A speed controller circuit for a radio controlled model having a battery with first and second battery terminals and a motor with first and second motor terminals, the speed controller circuit comprising:

a first node for connection to the first battery terminal and the first motor terminal, a second node for connection to the second battery terminal, and a third node for connection to the second motor terminal;

drive subcircuit means connected between the second and third nodes for switching between a DRIVE ON state of the drive subcircuit in which the drive subcircuit couples the second node to the third node, in order to couple the second battery terminal to the second motor terminal and thereby power the motor, and a DRIVE OFF state of the drive subcircuit in which the second node is decoupled from the third node;

brake subcircuit means connected between the first and third nodes for switching between a BRAKE ON state of the brake subcircuit in which the brake subcircuit couples the first node to the third node, in order to couple the first motor terminal to the second motor terminal and thereby brake the motor, and a BRAKE OFF state of the brake subcircuit in which the first node is decoupled from the third node; and control subcircuit means connected to the drive subcircuit and the brake subcircuit for switching the drive subcircuit and the brake subcircuit under program control;

wherein the brake subcircuit includes a diode connected across the first and third nodes as means for conducting a flyback current;

wherein the control subcircuit means includes sensing means for sensing when the diode is forward biased beyond a predetermined threshold level as an indication that the diode is conducting the flyback current; and wherein the control subcircuit means is programmed to switch the brake subcircuit to the BRAKE ON state in synchronism with the diode being forward biased beyond the predetermined threshold level in order to thereby more efficiently conduct the flyback current.

7. A method of conducting flyback current in a speed controller circuit for a radio controlled model, comprising:

providing a speed controller circuit having (i) a first node for connection to the first battery terminal and the first motor terminal, (ii) a second node for connection to the second battery terminal, (iii) a third node for connection to the second motor terminal, (iv) drive subcircuit means connected between the second and third nodes for switching between a DRIVE ON and DRIVE OFF states of the drive subcircuit, (v) brake subcircuit means connected between the first and third nodes for switching between BRAKE ON and BRAKE OFF states of the brake subcircuit, which brake circuit includes a diode connected across the first and third nodes as means for conducting flyback current, and (vi) control subcircuit means connected to the drive subcircuit and the brake subcircuit for switching the drive subcircuit and the brake subcircuit under program control;

sensing when the diode is forward biased beyond a predetermined threshold level as an indication that the diode is conducting the flyback current; and p1 switching the brake subcircuit to the BRAKE ON state in synchronism with the diode being forward biased beyond the predetermined threshold level in order to thereby more efficiently conduct the flyback current.

* * * * *